US005859528A

United States Patent [19]

Honma

[11] Patent Number: 5,859,528

[45] Date of Patent: Jan. 12, 1999

[54] VOLTAGE-TO-CURRENT CONVERTER FOR OUTPUTTING A CURRENT WHICH VARIES IN PROPORTION TO AN INPUT VOLTAGE

[75] Inventor: Tomoyuki Honma, Yokohama, Japan

[73] Assignee: Kabushiki Kaisha Toshiba, Kawasaki, Japan

[21] Appl. No.: 880,693

[22] Filed: Jun. 23, 1997

[30] Foreign Application Priority Data

Jun. 24, 1996 [JP] Japan ..... 8-163035

[51] Int. Cl.[6] ..... G05F 3/16

[52] U.S. Cl. ..... 323/315; 323/316

[58] Field of Search ..... 323/315, 316, 323/317; 307/103, 542

[56] References Cited

U.S. PATENT DOCUMENTS 4,354,122 10/1992 Embree et al. ..... 327/103

FOREIGN PATENT DOCUMENTS 5-259755 10/1993 Japan .

*Primary Examiner*—Shawn Riley

*Attorney, Agent, or Firm*—Oblon, Spivak, McClelland, Maier & Neustadt, P.C.

[57] ABSTRACT

A voltage-to-current converter comprises first to third transistors, first and second resisntaces, and a current mirror circuit. The first transistor is an emitter follower transistor, and has a base for receiving an input signal. The second transistor and the first resistor constitute a grounded-emitter amplifier circuit of the output stage. The base of the second transistor is connected to the emitter of the first transistor. The third transistor and the second resistor have the same characteristics as the second transistor and the first resistor, respectively. The base of the third transistor is connected to the emitter of the first transistor. The current mirror circuit supplies a current proportional to the collector current of the third transistor to the emitter of the first transistor.

15 Claims, 2 Drawing Sheets

VOLTAGE-TO-CURRENT CONVERTER FOR OUTPUTTING A CURRENT WHICH VARIES IN PROPORTION TO AN INPUT VOLTAGE

BACKGROUND OF THE INVENTION

The present invention relates to a voltage-to-current converter which can be used as, e.g. a control circuit for controlling an electronic volume, and which outputs a current linearly varying in proportion to an input voltage.

FIG. 4 shows a conventional voltage-to-current converter. The converter comprises a PNP transistor Q1 of emitter follower type and an NPN transistor Q2 having a base connected to the emitter (i.e. output terminal) of the transistor Q1. To be more specific, the transistor Q1 having its base connected to an input terminal 41, its collector to a ground terminal 44 and its emitter to a power terminal 42 through a constant current source I1. Furthermore, the emitter of the transistor Q1 is connected to the base of the transistor Q2. The collector of the transistor Q2 is connected to an output terminal 43, and the emitter of the transistor Q2 is connected to the ground terminal 44 through a resistor R1.

In the above conventional converter, an input voltage Vin is applied to the input terminal 41, and an output current Iout is supplied from the output terminal 43. The current Iout flows forward, from the output terminal 43 to the collector of the transistor Q2. The current Iout is expressed as follows:

$$Iout=(Vin+VBEQ1-VBEQ2)/R1$$

where VBEQ1 is the voltage between the base and the emitter of the transistor Q1, and VBEQ2 is the voltage between the base and the emitter of the transistor Q2.

If VBEQ1 is equal to VBEQ2, the output current Iout varies in proportion to the input voltage Vin.

In the conventional converter, VBEQ1 and VBEQ2 are given by:

$$VBEQ1=VT\ 1n\times(I1/IS)$$

$$VBEQ2=VT\ 1n\times(Iout/IS)$$

where VT is kT/q or a thermoelectromotive force constant, and IS is a saturation current. The saturation currents of the transistors provided in integrated circuits are equal if the integrated circuits have been made in the same process. The transistor Q1 is biased with the constant current I1, and the transistor Q2 is biased with the output current Iout. Voltages VBEQ1 and VBEQ2 are therefore not equal. The difference between VBEQ1 and VBEQ2 is not expressed by a linear function. This means that the variation Δ Iout of the output current is not proportional to the variation Δ Vin of the input voltage.

Jpn. Pat. Appln. KOKAI Publication No. 5-259755 discloses a voltage-to-current converter. However, the converter needs a large number of current mirror circuits, and thus has a complicated structure.

BRIEF SUMMARY OF THE INVENTION

An object of the present invention is to provide a voltage-to-current converter for outputting a current which more linearly varies in proportion to an input voltage.

Another object of the present invention is to provide a voltage-to-current converter having a simple structure.

The present invention is realized by the following voltage-to-current converter. As shown in FIG. 1, the converter has a grounded-emitter transistor Q2, a resistor R1, a transistor Q3 having the same structure as the transistor Q2, a resistor R2 having the same structure as the resistor R1, and a current mirror circuit 11. The current mirror circuit 11 supplies the same current as the collector current of the transistor Q3 to a transistor Q1 as a bias current. Furthermore, a constant current source 12 is provided as a starter for supplying a bias current to the transistor Q1 at the initial operation time when the converter is activated. A constant current I2 supplied from the constant current source I2 is sufficiently small, as compared with the current Iout output from the output terminal of the converter, i.e., the collector current of the transistor Q2.

In this converter, the output Iout, which is the collector current of the transistor Q2, is expressed as follows:

$$Iout=(Vin+VBEQ1-VBEQ2)/R1$$

where Vin is an input voltage, and VBEQ1 and VBEQ2 are the base-emitter voltages of the transistors Q1 and Q2, respectively. Since VBEQ1 and VBEQ2 are nearly equal in value and vary in the same manner, the following equation is satisfied:

Iout=Vin/R1

Thus, the output current Iout varies substantially linearly in proportion to the input voltage Vin.

According to the present invention, the bias current of the transistor of the input stage is the same as that of the transistor of the output stage, and thus the converter can output a current which very linearly varies in proportion to an input voltage.

The current mirror circuit may supply a current proportional to the corrector current of the second transistor to the first transistor.

The first and second resistances may be formed as a single resistance.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The embodiments of the invention will be described, with reference to the accompanying drawings.

Figure 1:
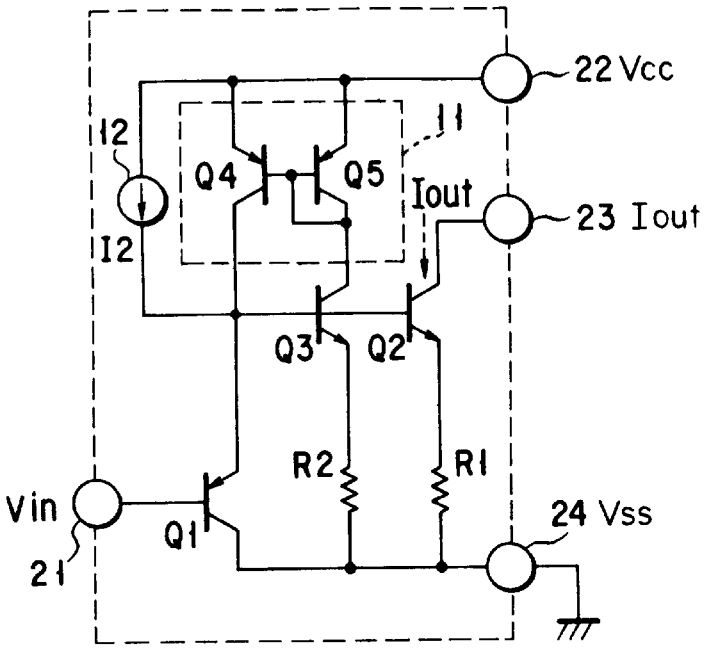
FIG. 1 is a circuit showing a voltage-to-current converter of the first embodiment of the present invention.

FIG. 1 shows the voltage-to-current converter of the first embodiment of the present invention. The converter has a grounded-emitter transistor Q2, a resistor R1, a transistor Q3 having the same structure as the transistor Q2, a resistor R2 having the same structure as the resistor R1, and a current mirror circuit 11. The current mirror circuit 11 supplies the same current as the collector current of the transistor Q3 to the transistor Q1 as a bias current. Furthermore, a constant current source 12 is provided as a starter for supplying a bias current to the transistor Q1 at the initial operation time when the converter is activated. A constant current I2 supplied from the constant current source 12 is sufficiently small, as compared with the current Iout output from the output terminal of the converter, i.e., the corrector current of the transistor Q2.

The structure of the converter of the first embodiment will be explained in more detail.

The transistor Q1 of the converter, for example, is a PNP transistor, and comprises its base connected to an input terminal 21, its collector connected to a ground terminal 24, and its emitter connected to a power terminal 22 through the constant current source 12. Furthermore, the emitter of the transistor Q1 is connected to the collector of a transistor Q4 which serves as the output terminal of the current mirror circuit 11. In this case, the transistor Q4 is a PNP transistor. The emitter of the transistor Q1 is connected to the base of the transistor Q3 which has conductivity opposite to the conductivity of the transistor Q1. In the above case, the transistor Q3 is an NPN transistor. The emitter of the transistor Q3 is connected to the ground terminal 24 through the resistor R2, and the collector of the transistor Q3 is connected to the bases of the transistors Q4 and Q5 and the collector of a transistor Q5 which is a PNP transistor in this case. The collector of the transistor Q5 serves as the input terminal of the current mirror circuit 11. Furthermore, the emitter of the transistor Q1 is connected to the base of the transistor Q2 which is an NPN transistor. The transistor Q2 has its collector connected to an output terminal 23 and its emitter connected to the ground terminal 24 through the resistor R1. The emitters of the transistors Q4 and Q5 which constitute the current mirror circuit 11 are connected to the power terminal 22.

Figure 4:
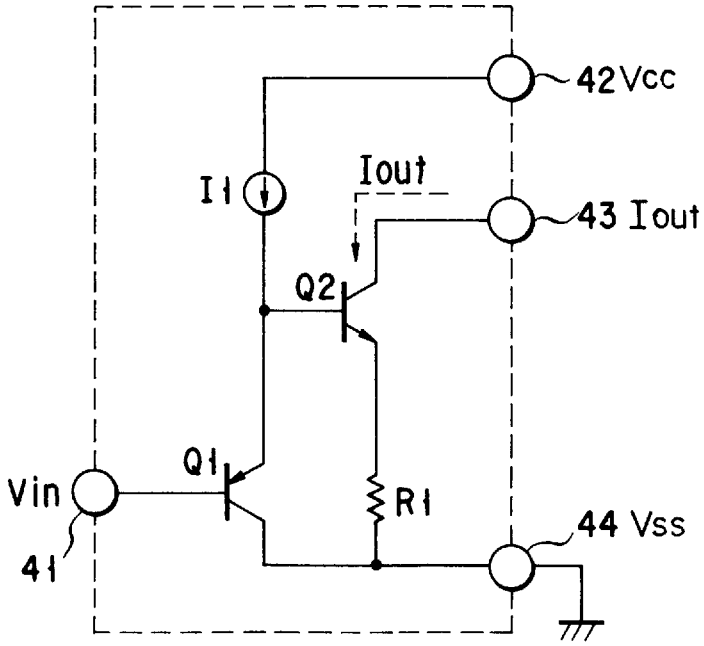
FIG. 4 is a circuit diagram showing a conventional voltage-to-current converter.

In this embodiment, the output current Iout, which is the collector current of the transistor Q2, is expressed as follows:

$$Iout=(Vin+VBEQ1-VBEQ2)/R1$$

where Vin is an input voltage, and VBEQ1 and VBQ2 are the base-emitter voltages of the transistors Q1 and Q2, respectively, as in the converter shown in FIG. 4.

Suppose that the transistors Q2 and Q3 have the same size and the same characteristics, the resistors R1 and R2 have the same resistance value, and the ratio of the input current of the current mirror circuit 11 to the output current thereof is 1:1. In this case, the collector current of the transistor Q3 is equal to the output current Iout, and the emitter current of the transistor Q1 is given by "Iout+I2". Thus, the following equations are satisfied:

$$VBEQ1=VT\times 1n((Iout+I2)/IS)$$

$$VBEQ2=VT\times 1n(Iout/IS)$$

As described above, Iout >>I2, and thus VBEQ1=VBEQ2.

Therefore, the base emitter voltage of the transistor Q1 of the input stage and that of the transistor Q2 vary in the same manner, and the variations of the base-emitter voltages cancel each other. In other words, the following equation is satisfied:

$$Iout=Vin/R1$$

Thus, the output current Iout varies substantially linearly in proportion to the input voltage Vin.

The constant current source 12 is provided to turn on the transistors Q2 and Q3 at the initial operation time. However, the converter does not necessarily need to have the constant current source 12 since the transistors Q2 and Q3 can be turned on with a leakage current. In the case where the constant current source 12 is not provided, the number of elements constituting the converter is decreased, and the output current more linearly varies in proportion to the input voltage.

Furthermore, in the first embodiment, the transistor Q2 is identical to the transistor Q3, the resistor R1 is identical to the resistor R2, and the ratio of the input current of the current mirror circuit 11 to the output current thereof is 1:1. However, the condition of the converter is not limited to the above condition. For example, the converter may be set such that the transistor Q3 is identical to the transistor Q2, the resistor R2 has a value greater an n-number of times than the value of the resistor R1, and the ratio of the input current of the current mirror circuit 11 to the output current thereof is 1:n.

Figure 2:
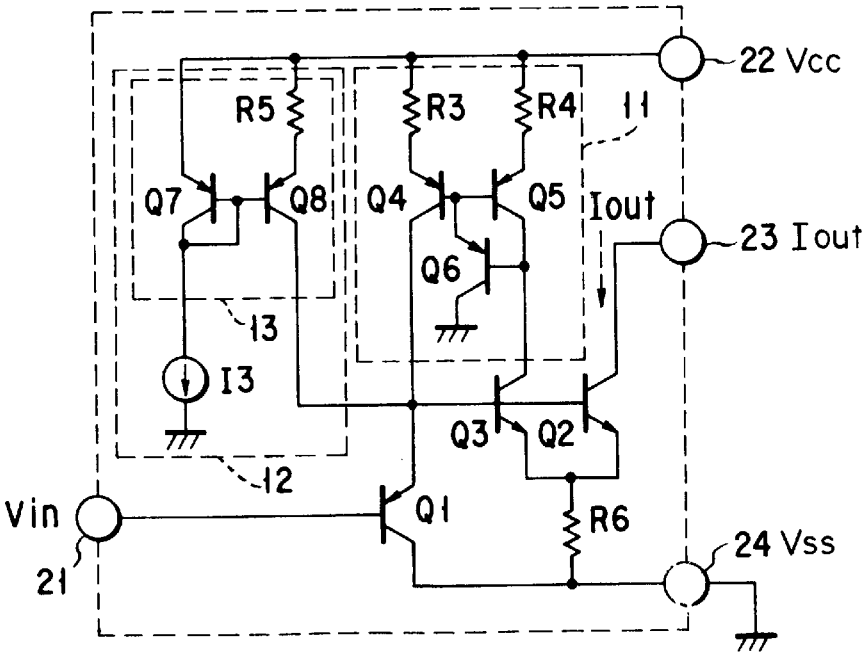
FIG. 2 is a circuit diagram showing a voltage-to-current converter of the second embodiment of the present invention.

FIG. 2 shows the voltage-to-current converter of the second embodiment of the present invention. The same structural elements in the second embodiment that have already been discussed in the first embodiment are denoted by the same reference numerals, and the explanations therefor will be omitted.

The voltage-to-current converter of the second embodiment is featured in that a resistor R6 substitutes for the resistor R2 connected to the emitter of the transistor Q3 and the resistor R1 connected to the emitter of the transistor Q2, which are shown in FIG. 1. Furthermore, the current mirror circuit 11 and the constant source 12 of the second embodiment differ in structure from those of the first embodiment.

More specifically, in the converter of the second embodiment, the emitter of the transistor Q2 and the emitter of the transistor Q3 are grounded through the resistor R6. Thus, the converter can adjust the difference between the bias currents of the transistors Q1 and Q2, which results from the difference between the resistance values of the resistors R1 and R2, such that the bias current of the transistor Q1 is equal to that of the transistor Q2. As a result, the output current Iout more linearly varies in proportion to the variation of the input voltage Vin.

Furthermore, the emitter current of the transistor Q2 and that of the transistor Q3 flow through the resistor R6. Therefore, even if the resistance value of the resistor R6 is set to be smaller than that of the resistor R1, the input voltage Vin can be decreased by the resistor R6 to the same degree as in the first embodiment shown in FIG. 1. By virtue of the above feature, in the second embodiment, the number of resistances is small, and the region therefor also is small.

Furthermore, in the second embodiment, the current mirror circuit 11 comprises resistors R3 and R4 and transistors Q4, Q5 and Q6 which are PNP transistors in the above case. The collector of the transistor Q5 is the input terminal of the current mirror circuit 11, and connected to the base of the transistor Q6. The collector of the transistor Q6 is grounded, and the emitter thereof is connected to the bases of the transistors Q4 and Q5. The emitters of the transistors Q4 and Q5 are connected to a power terminal 22 through the resistors R3 and R4. The collector of the transistor Q4 is the output terminal of the current mirror circuit 11, and connected to the emitter of the transistor Q1. The base currents of the transistors Q4 and Q5 can be corrected by the transistor Q6, and thus the output current is stable even if the temperature or the like changes, thus ensuring high current characteristics.

In addition, in the second embodiment, the constant current source 12 comprises a constant current source I3, a current mirror circuit 13 constituted by transistors Q7 and Q8, and a resistor R5 connected to the emitter of the transistor Q8. The current mirror circuit 13 supplies a current proportional to the output current of the constant current source I3 to the emitter of the transistor Q1. However, the converter of the second embodiment, as well as the converter of the first embodiment, does not necessarily need to have the constant current source 12.

Figure 3:
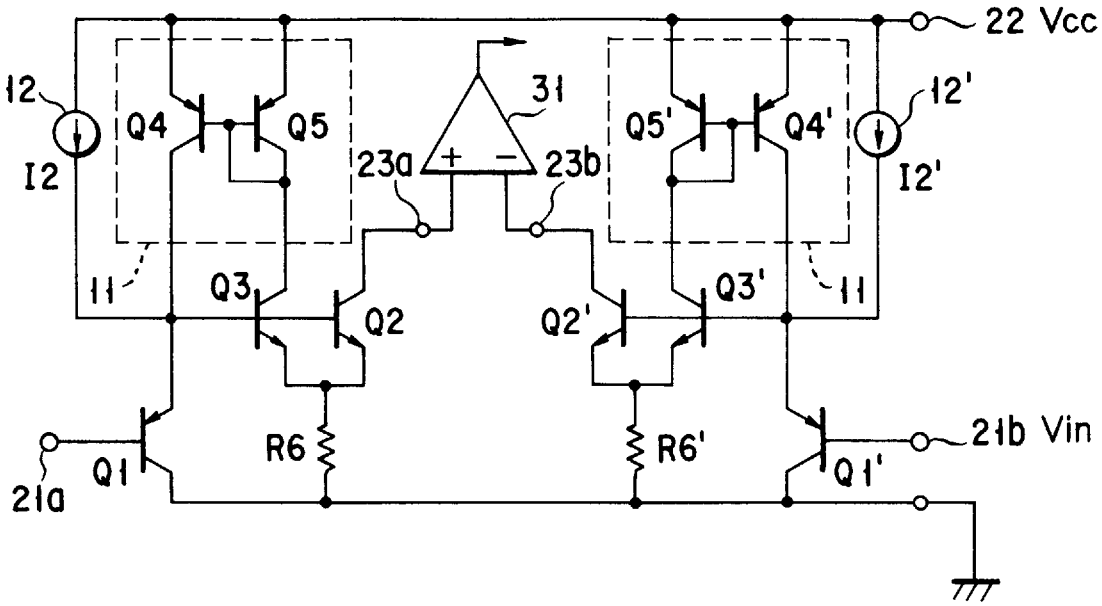
FIG. 3 is a circuit diagram showing voltage-to-current converters of the third embodiment of the present invention.

FIG. 3 shows the voltage-to-current converters of the third embodiment of the present invention. The same structural element of the third embodiment that have already been discussed in the second embodiment are denoted by the same reference numerals, and the explanations thereof will be omitted.

The voltage-to-current converters of the third embodiment are applied to the output stage of a differential amplifier, and designed to output a non-inverted signal and an inverted signal.

More specifically, in the third embodiment, the base of the transistor Q1 is connected to a non-inverted signal-input terminal 21*a*, and the collector of the transistor Q2 is connected to a non-inverted signal-output terminal 23*a*. The non-inverted signal-output terminal 23*a* is connected to an non-inverted signal-input terminal of, e.g. a differential amplifier 31. The transistors Q1, Q2 and Q3, the resistor R6, the current mirror circuit 11 constituted by the transistors Q4 and Q5, and the constant current source 12 constitute one of the voltage-to-current converters, which is the same as the voltage-to-current converter shown in FIG. 2.

Furthermore, in the third embodiment, the base of a transistor Q1' is connected to an inverted signal-input terminal 21*b*, and the collector of a transistor Q2' is connected to an inverted signal-output terminal 23*b*. The inverted signal-output terminal 23*b* is connected to an inverted signal-input terminal of the differential amplifier 31. The transistors Q1', Q2' and Q3', a current mirror circuit 11' constituted by transistors Q4' and Q5', a constant current source 12', and a resistor R6' constitute the other voltage-to-current converter which is identical to said one of the voltage-to-current converters.

In the third embodiment, the output current to be supplied to the non-inverted signal-output terminal 23*a* or the inverted signal output terminal 23*b* linearly varies in proportion to the input voltage applied to the non-inverted signal-input terminal 21*a* or the inverted signal-input terminal 21*b*. Thus, the distortion characteristics of the current are improved. Furthermore, the transistors Q2, Q3, Q2' and Q3' are biased with the respective resistances, and thus the dynamic range of the input can be increased.

In addition, in the third embodiment as in the first embodiment, the emitters of the transistors Q2, Q3, Q2' and Q3' may be grounded through the resistors R1, R2, R1' and R2', respectively, instead of through the resistors R6 and R6'.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

I claim:

1. A voltage-to-current converter comprising:

a first transistor of an emitter follower type having a base connected to an input terminal;

a second transistor having a conductivity opposite to a conductivity of the first transistor, and including a base connected to an emitter of the first transistor, an emitter grounded through a first resistor, and a collector connected to an output terminal;

a third transistor having characteristics which are the same as characteristics of the second transistor, and including a base connected to the emitter of the first transistor, and an emitter grounded through a second resistor; and a current mirror circuit, connected to a collector of the third transistor and the emitter of the first transistor, for supplying a current identical to a collector current of the second transistor to the emitter of the first transistor.

2. The converter according to claim 1, wherein the current mirror circuit supplies a current, which is proportional to a collector current of the second transistor, to the emitter of the first transistor.

3. A voltage-to-current converter comprising:

a first transistor of an emitter follower type having a base connected to an input terminal;

a second transistor having a conductivity opposite to a conductivity of the first transistor, and including a base connected to an emitter of the first transistor, an emitter grounded through a first transistor, and a collector connected to an output terminal;

a third transistor having characteristics which are the same as characteristics of the second transistor, and including a base connected to the emitter of the first transistor, and an emitter grounded through a second resistor;

a current mirror circuit, connected to a collector of the third transistor and the emitter of the first transistor, for supplying a current identical to a collector current of the second transistor to the emitter of the first transistor; and a constant current source, connected to the emitter of the first transistor, for supplying a current, which is smaller than the current supplied from the current mirror circuit to the emitter of the first transistor, to the emitter of the first transistor when the converter is activated.

4. The converter according to claim 3, wherein the current supplied from the constant current source is smaller in magnitude than a collector current of the second transistor.

5. A voltage-to-current converter comprising:

a first transistor of an emitter follower type having a base connected to an input terminal;

a second transistor having a conductivity opposite to a conductivity of the first transistor, and including a base connected to an emitter of the first transistor, and a collector connected to an output terminal;

a third transistor having characteristics which are the same as characteristics of the second transistor, and including a base connected to the emitter of the first transistor;

a resistor having ends, one of the ends being connected to an emitter of the second transistor and an emitter of the third transistor, the other being grounded; and a current mirror circuit, connected to the emitter of the first transistor and a collector of the third transistor, for supplying a current identical to a collector current of the third transistor to the emitter of the first transistor.

6. The converter according to claim 5, wherein the current mirror circuit supplies a current, which is proportional to a collector current of the second transistor, to the emitter of the first transistor.

7. A voltage-to-current converter comprising:

a first transistor of an emitter follower type having a base connected to an input terminal;

a second transistor having a conductivity opposite to a conductivity of the first transistor, and including a base connected to an emitter of the first transistor, and a collector connected to an output terminal;

a third transistor having characteristics which are the same as characteristics of the second transistor, and including a base connected to the emitter of the first transistor;

a resistor having ends, one of the ends being connected to an emitter of the second transistor and an emitter of the third transistor, the other being grounded;

a current mirror circuit, connected to the emitter of the first transistor and a collector of the third transistor, for supplying a current identical to a collector current of the third transistor to the emitter of the first transistor; and a constant current source circuit, connected to the emitter of the first transistor, for supplying a current, which is smaller than the current supplied from the current mirror circuit to the emitter of the first transistor, to the emitter of the first transistor.

8. The converter according to claim 7, wherein the current supplied from the constant current source circuit is smaller than a collector current of the second transistor.

9. The converter according to claim 8, wherein the constant current source circuit comprises:

a constant current source; and a current mirror circuit, connected to the constant current source and the emitter of the first transistor, for supplying a current, which is proportional to an output current of the constant current source, to the emitter of the first transistor.

10. A voltage-to-current converter comprising:

a first transistor of an emitter follower type having a collector grounded and a base connected to a non-inverted signal-input terminal;

a second transistor having a conductivity opposite to a conductivity of the first transistor, and including a base connected to an emitter of the first transistor, and a collector connected to a non-inverted signal-output terminal;

a third transistor having characteristics which are the same as characteristics of the second transistor, and including a base connected to the emitter of the first transistor;

a first resistor having ends, one of the ends being connected to an emitter of the second transistor and an emitter of the third transistor, the other being grounded;

a first current mirror circuit, connected to the emitter of the first transistor and a collector of the third transistor, for supplying a current identical to a collector current of the third transistor to the emitter of the first transistor;

a fourth transistor including a collector grounded and a base connected to an inverted signal-input terminal;

a fifth transistor having conductivity opposite to conductivity of the fourth transistor, and including a base connected to an emitter of the fourth transistor and a collector connected to an inverted signal-output terminal;

a sixth transistor including a base connected to the emitter of the fourth transistor, and having the same conductivity and the same characteristics as the fifth transistor;

a second resistor having ends, one of the ends being connected to an emitter of the fifth transistor, the other being grounded; and a second current mirror circuit, connected to the emitter of the fourth transistor and a collector of the sixth transistor, for supplying a current identical to a collector current of the sixth transistor to the emitter of the fourth transistor.

11. The converter according to claim 10, further comprising a first constant current source, connected to the emitter of the first transistor, for supplying a current which is smaller than the current supplied from the first mirror circuit to the emitter of the first transistor, to the emitter of the first transistor.

12. The converter according to claim 10, further comprising a second constant current source, connected to the emitter of the fourth transistor, for supplying a current, which is smaller than the current supplied from the second mirror circuit, to the emitter of the fourth transistor.

13. The converter according to claim 10, wherein the first current mirror circuit supplies a current, which is proportional to the collector current of the third transistor, to the emitter of the first transistor.

14. The converter according to claim 10, wherein the second mirror circuit supplies a current, which is proportional to the collector current of the sixth transistor, to the emitter of the fourth transistor.

15. The converter according to claim 10, further comprising a differential amplifier connected to the inverted signal-output terminal and the non-inverted signal output terminal.

* * * * *